US008915103B2

(12) United States Patent
Sar et al.

(10) Patent No.: US 8,915,103 B2
(45) Date of Patent: Dec. 23, 2014

(54) WASHER/DRYER WITH A LIGHT SOURCE INSIDE A BAFFLE FOR ILLUMINATING THE DRUM

(75) Inventors: Can Sar, Istanbul (TR); Sinan Sekban, Istanbul (TR); Levent Cinar, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1437 days.

(21) Appl. No.: 12/513,012

(22) PCT Filed: Oct. 30, 2007

(86) PCT No.: PCT/EP2007/061664

§ 371 (c)(1),
(2), (4) Date: Feb. 2, 2010

(87) PCT Pub. No.: WO2008/052985

PCT Pub. Date: May 8, 2008

(65) Prior Publication Data

US 2010/0132413 A1 Jun. 3, 2010

(30) Foreign Application Priority Data

Oct. 31, 2006 (TR) ..... a 2006 06045

(51) Int. Cl.
*D06F 39/00* (2006.01)
*F21V 33/00* (2006.01)

(52) U.S. Cl.
CPC ..... *D06F 39/00* (2013.01); *F21V 33/0044* (2013.01)
USPC ..... 68/19; 68/142

(58) Field of Classification Search
CPC ..... D06F 39/00; F21V 33/0044
USPC ..... 68/20, 139, 142; 362/89, 91, 92, 93, 94
See application file for complete search history.

(56) References Cited

U.S. PATENT DOCUMENTS

| | | | | |
|---|---|---|---|---|
| 2,752,694 | A * | 7/1956 | McCormick | 34/60 |
| 3,399,464 | A * | 9/1968 | Erickson et al. | 34/605 |
| 4,899,264 | A * | 2/1990 | Ries et al. | 362/92 |
| 5,187,879 | A * | 2/1993 | Holst | 34/261 |
| 5,463,821 | A * | 11/1995 | Gauer | 34/261 |
| 5,836,669 | A * | 11/1998 | Hed | 362/92 |
| 5,869,932 | A * | 2/1999 | Choi | 315/76 |
| 5,983,520 | A * | 11/1999 | Kim et al. | 34/261 |
| 6,370,798 | B1 * | 4/2002 | Gonzalez, Sr. | 34/595 |
| 7,627,919 | B2 * | 12/2009 | Lee et al. | 8/158 |

(Continued)

FOREIGN PATENT DOCUMENTS

| | | |
|---|---|---|
| DE | 4426074 C1 | 10/1995 |
| DE | 19649039 C1 | 4/1998 |

(Continued)

OTHER PUBLICATIONS

International search report included with the application as filed.

*Primary Examiner* — Joseph L Perrin
(74) *Attorney, Agent, or Firm* — Venjuris PC

(57) ABSTRACT

The present invention relates to a washer/dryer (1) comprising a drum (2) wherein the laundry is placed and at least one drum baffle (3) extending in the radial direction towards the center of the drum (2) for tumbling the laundry and wherein the interior of the drum (2) is illuminated effectively.

11 Claims, 1 Drawing Sheet

(56) References Cited

U.S. PATENT DOCUMENTS

| | | | | |
|---|---|---|---|---|
| 8,016,444 | B2 * | 9/2011 | Cho et al. | 362/91 |
| 2004/0139556 | A1 * | 7/2004 | Lee et al. | 8/158 |
| 2005/0268483 | A1 * | 12/2005 | Park et al. | 34/603 |

FOREIGN PATENT DOCUMENTS

| | | | |
|---|---|---|---|
| DE | 19906964 | A1 | 8/2000 |
| DE | 10316377 | B3 | 9/2004 |
| DE | 102004036672 | B3 | 12/2005 |

* cited by examiner

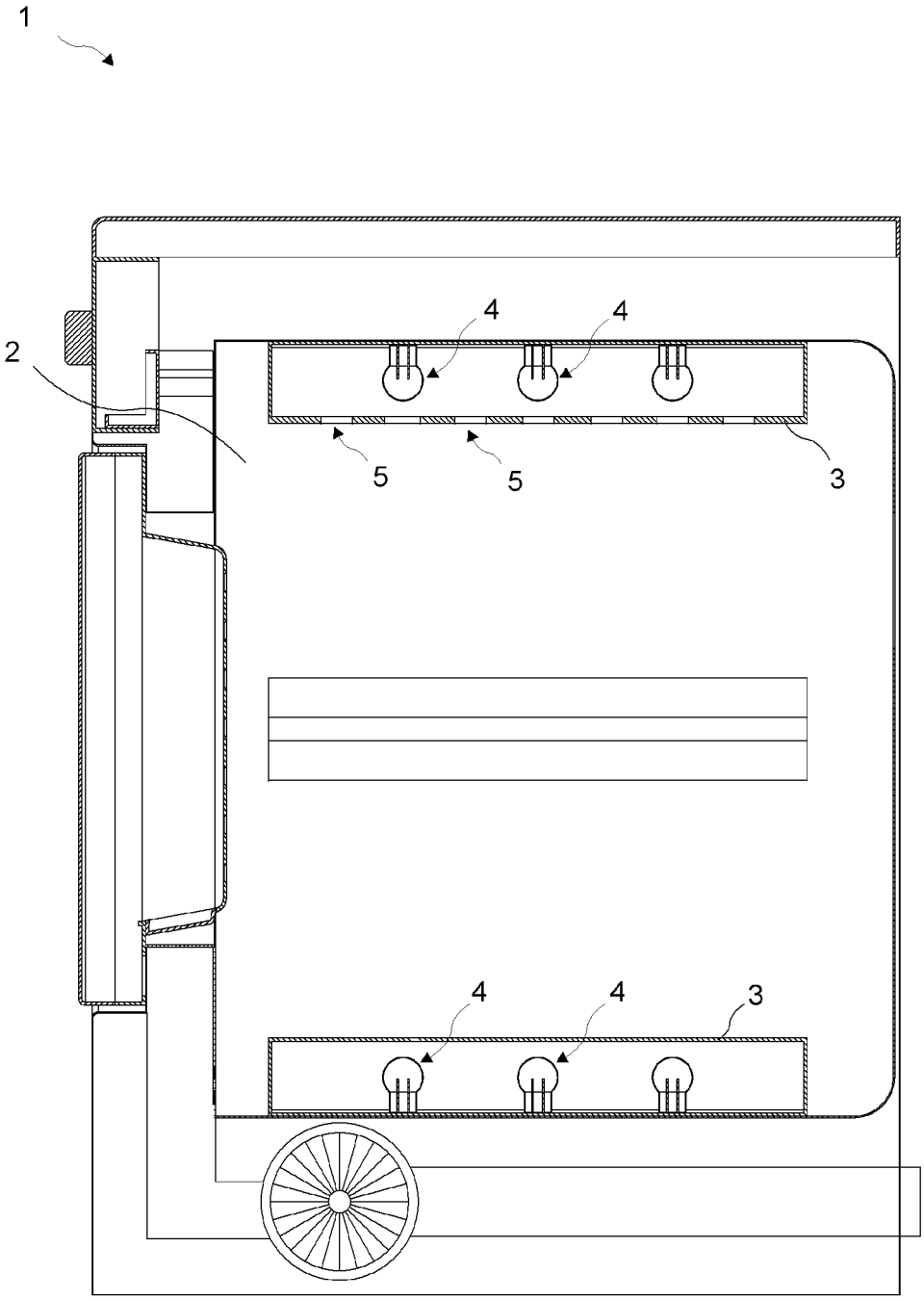
1
2
4
4
5
5
3
4
4
3

WASHER/DRYER WITH A LIGHT SOURCE INSIDE A BAFFLE FOR ILLUMINATING THE DRUM

The present invention relates to a washer/dryer wherein the interior of the drum is illuminated.

In washer/dryers a fixed light source for illuminating the interior of the drum is used and these light sources should be very well insulated so that they are not damaged because of the movable components such as the drum. Monitoring the laundry moving together with the drum becomes difficult when a fixed light source is used, a multiple number of light sources are required for good illumination and the energy consumption increases.

In the United States of America patent document no. U.S. Pat. No. 4,899,264, a lamp is assembled outside of the drum for illuminating the interior of the dryer drum.

In the United States of America patent document no. U.S. Pat. No. 5,463,821, in a microwave dryer, the magnetrons that emit microwave energy are placed inside drum baffles.

In the German patent document no. DE 10316377, in a direct drive washing machine, the light emitted from a fixed lamp in the machine body is directed into the drum by means of a transparent rod that is disposed axially in the hollow motor drive shaft.

The aim of the present invention is the realization of a washer/dryer wherein the interior of the drum is illuminated effectively.

The washer/dryer realized in order to attain the aim of the present invention is explicated in the claims.

In the washer/dryer of the present invention, inside the drum wherein laundry is placed, light sources, e.g. lamps are disposed in the space between the drum baffles that tumble the laundry and the inner surface of the drum, for illuminating the interior of the drum by emitting light outwards from inside the drum baffles.

In an embodiment of the present invention, the drum baffles are manufactured of a transparent material such as glass or a plastic material with a high light transparency so that the light emitted from the light source at the interior can be transmitted outside.

In another embodiment of the present invention, the drum baffle is manufactured of an opaque material and comprises holes thereon for transmitting light.

The washer/dryer realized in order to attain the aim of the present invention is illustrated in the attached figures, where:

FIG. 1—is the schematic view of a washer/dryer.

The elements illustrated in the figures are numbered as follows:

1. Washer/dryer
2. Drum
3. Drum baffle
4. Light source
5. Hole The washer/dryer (1) comprises a drum (2) wherein the laundry is placed and at least one drum baffle (3) disposed in the drum (2) that provides turning over and tumbling the laundry.

The drum baffle (3) is produced of a thin material, for example by bending a plate or injecting plastic with a thin wall thickness so that the weight and cost are not high and a hollow volume is provided inside the drum baffle (3) that is assembled on the inner surface of the drum (2). If the drum baffle (3) is shaped for example like a V, the surfaces forming the V shape of the drum baffle (3) and the inner surface of the drum (2) define the limits of the hollow space inside the drum baffle (3).

The washer/dryer (1) of the present invention comprises one or more light sources (4) that are disposed inside the drum baffle (3) for illuminating the interior of the drum (2) by transmitting light from inside the drum baffles (3) towards the outside.

In the washer/dryer (1) the electric energy required for the light sources (4) is supplied by a power source and power is transmitted to the drum (2) from the power source by means of current transmitting brushes. The brushes that transmit the current are in touch with the contact ring that are electrically insulated from the drum (2) and assembled on the front or rear wall of the drum (2) and the current delivered to the contact ring by the brushes is transmitted to the light sources (4) by means of cables.

In an embodiment of the present invention, the drum baffle (3) is manufactured of a transparent material such as glass or a polymer based material with a high light transparency. In this embodiment, the light is emitted to the interior of the drum (2) from all the surfaces of the drum baffle (3) facing the interior of the drum (2).

In another embodiment of the present invention, the drum baffle (3) is produced of an opaque material and comprises one or more holes (5) that allow the light emitted from the light source (4) disposed therein to be transmitted to the interior of the drum (2). The holes (5) are formed on all the surfaces of the drum baffle (3) facing the interior of the drum (2) and are covered in a leak-proof manner by a material that is transparent or having a high light transparency. Consequently light is transmitted to the interior of the drum (2) through the holes (5) on the drum baffle (3) and the water is prevented from seeping in from the holes (5) and reaching the light sources (4).

In this embodiment, the amount of illumination can be adjusted by arranging the holes (5) on the drum baffle (3) with close intervals for regions to be illuminated intensively and with wide apart intervals for regions to be illuminated less.

The light sources (4) are automatically energized when the washer/dryer (1) is operated and are de-energized when the washing or drying process is completed or can be selectively opened, closed with a knob by the user.

In the embodiment of the present invention, since the light sources (4) are covered up by the drum baffles (3), a separate structure such as a protective casing is not required.

Effective illumination is provided by directing the light from the drum baffles (3) directly to the interior of the drum (2). A small number of light sources (4) are sufficient for good lighting and thus energy is saved.

The invention claimed is:

1. A washer/dryer (1) comprising
- a drum (2) having a contact ring and wherein the laundry is placed, and
- at least one drum baffle (3) disposed in the drum (2) for turning over and tumbling the laundry and
- one or more light sources (4) that are disposed inside the drum baffle (3) and are coupled to the contact ring, and
- a power source that transmits power to the one or more light sources (4) using current transmitting brushes in touch with the contact ring and
- wherein the one or more light sources (4) illuminate the interior of the drum (2) by transmitting light from inside the drum baffles (3) towards the outside.

2. The washer/dryer (1) as in claim 1, wherein the drum baffle (3) produced of a transparent material or of a material with a high light transparency.

3. The washer/dryer (1) as in claim 1, wherein the drum baffle (3) produced of an opaque material and comprising one or more holes (5) that allow the light emitted from the light source (4) disposed therein to be transmitted to the interior of the drum (2).

4. The washer/dryer (1) as in claim 3, wherein the drum baffle (3) comprising the holes (5) that are formed on all the surfaces of the drum baffle (3) facing the interior of the drum (2).

5. The washer/dryer (1) as in claim 4, wherein the drum baffle (3) comprising the holes (5) covered in a leak-proof manner by a material that is transparent or having a high light transparency.

6. The washer/dryer (1) as in claim 5, wherein the drum baffle (3) comprising the holes (5) arranged with close intervals for regions to be illuminated intensively and with wider apart intervals for regions to be illuminated less.

7. The washer/dryer (1) as in claim 3, wherein the drum baffle (3) comprising the holes (5) covered in a leak-proof manner by a material that is transparent or having a high light transparency.

8. The washer/dryer (1) as in claim 7, wherein the drum baffle (3) comprising the holes (5) arranged with close intervals for regions to be illuminated intensively and with wider apart intervals for regions to be illuminated less.

9. The washer/dryer (1) as in claim 3, wherein the drum baffle (3) comprising the holes (5) arranged with close intervals for regions to be illuminated intensively and with wider apart intervals for regions to be illuminated less.

10. A washer/dryer (1) comprising a drum (2) having a contact ring and wherein the laundry is placed, and at least one drum baffle (3) disposed in the drum (2) for turning over and tumbling the laundry and lamps (4) that are disposed inside the drum baffle (3) and are coupled to the contact ring, and a power source that transmits power to the one or more light sources (4) using current transmitting brushes in touch with the contact ring and wherein the lamps (4) illuminate the interior of the drum (2) by transmitting light from inside the drum baffles (3) towards the outside.

11. A washer/dryer (1) comprising a drum (2) having a contact ring and wherein the laundry is placed, and at least one drum baffle (3) without holes which transparent and disposed in the drum (2) for turning over and tumbling the laundry and lamps (4) that are disposed inside the drum baffle (3) and are coupled to the contact ring, and a power source that transmits power to the one or more sight sources (4) using current transmitting brushes in touch with the contact ring and wherein the lamps (4) illuminate the interior of the drum (2) by transmitting sight from inside the drum baffles (3) towards the outside.

* * * * *